United States Patent [19]

Waldman et al.

[11] Patent Number: 4,863,145

[45] Date of Patent: Sep. 5, 1989

[54] COOLING WHEEL FOR ANNEALING WIRE

[75] Inventors: Myron R. Waldman, Pawtucket, R.I.; Matthew S. Kressey, Plymouth, N.H.

[73] Assignee: WST Power Electronics, Inc., Providence, R.I.

[21] Appl. No.: 196,023

[22] Filed: May 19, 1988

Related U.S. Application Data

[63] Continuation of Ser. No. 78,555, Jul. 28, 1987, abandoned.

[51] Int. Cl.[4] ..... C21D 9/57

[52] U.S. Cl. ..... 266/109; 266/102

[58] Field of Search ..... 266/102, 103, 104, 109, 266/110; 219/155, 156; 148/153, 155, 156

[56] References Cited

U.S. PATENT DOCUMENTS 3,335,260 8/1967 Ferschl ..... 266/104
3,830,478 8/1974 Pietroni ..... 219/155
4,437,901 3/1984 Gentry ..... 266/103

FOREIGN PATENT DOCUMENTS 0050575 8/1889 Fed. Rep. of Germany .
0181244 9/1985 Japan .

*Primary Examiner*—S. Kastler

[57] ABSTRACT

An apparatus for and a method of cooling wire after it has been annealed comprising a cooling wheel which acts as a pulley for the wire downstream of the annealing apparatus, the rotatable cooling wheel having a hollow hub with a metal channel on its outside in which channel the heated wire is wrapped, the wire being cooled by the heat transfer through the metal channel wall to circulating water inside the hub, the water inside the hub kept circulating by a pair of flow passageways into and out of the hub cavity as well as by a stationary scrubber in the hub cavity which prevents the water from stagnating against the sides of the channel.

10 Claims, 3 Drawing Sheets

COOLING WHEEL FOR ANNEALING WIRE

This application is a continuation of application Ser. No. 78,555, filed July 28, 1987, now abandoned.

FIELD OF THE INVENTION

This invention relates to an apparatus for and a method of cooling wire after it has been annealed.

BACKGROUND OF THE INVENTION

Metal wire is formed by a drawing process which causes the metal to harden and to lose some of its elasticity. In order to soften the wire and thus restore its flexibility, the drawn wire is annealed as part of the overall wire-making process. Annealing involves rapidly heating a section of the wire, after which the heated wire must be cooled.

Usually, annealing of wire is done by electricity. An electric current is either run through a portion of the drawn wire, which acts as a short circuit, or a current is induced in a portion of the drawn wire by a transformer-type arrangement with the portion of the wire to be treated acting as a secondary transformer winding. In either case, the resulting current through the selected portion of the wire causes its temperature to increase, and the wire softens. Most often, this process take place continuously as the wire travels between and around various spools or pulleys. Subsequently, as part of the process, the annealed wire is then usually cooled by passing the heated wire through some water.

Water cooling of the annealed wire has several drawbacks, however. First, as the heated wire is well above the boiling temperature of water to begin with, the actual heat transfer between the wire and the water is difficult to predict or measure accurately and some metals, such as stainless steel, require close control of this quench time/temperature relationship in order to maintain consistent wire quality. In addition, when the annealing is done by means of electricity, the annealed portion of the wire or "hot leg" must be of fixed length in order to accurately control the annealing process in terms of time and temperature. When a water quench is used, this leg is considered to end at the surface of the water. This is not precisely accurate, particularly in view of the imprecise way the heat flows from the wire to the water, which is boiling off into stream as a result of its contact with the hot wire.

Also, the water quench method of cooling an annealed wire is not as fast as desired, and in the case of wires with multiple strands, some water will become lodged between the strands. This water is difficult to remove, and it will interfere with subsequent processing of the wire.

Accordingly, an object of this invention is to provide an apparatus for and method of cooling annealed wire without direct water contact.

Another object of the invention is to provide such an apparatus and method which is faster and more accurately calculated than the water quench method.

Another object of the invention is to provide such an apparatus and method by which anneal quality may be maintained at a consistent level.

Another object of the invention is to provide an apparatus for cooling an annealed wire as part of one of the electrical contacts for the electrical annealing process.

SUMMARY OF THE INVENTION

We have discovered an apparatus for and a method of cooling an annealed wire which comprises a cooling wheel having an outer metal channel around its external circumference, which channel holds the heated wire and cools it because of an internal cavity in the wheel which is filled with cooling water, the water in the cavity being recirculated, which action is aided by the relative rotation of the wheel with respect to an internal scrubber disposd in the cavity.

In the preferred embodiment, the annealed wire is run through a series of pulleys and through an induction heating unit, which induces a current in a portion of the wire. This heats the wire to a sufficient degree to anneal it. A pair of pulleys are disposed at each end of the induction unit, and the take up pulley comprises a cooling wheel.

The cooling wheel has a cylindrical hub which has a wire-holding channel around its outer circumference. The heated wire is wrapped around the hub in this channel at least once after it comes from the induction unit. The hub has a cylindrical, hollow cavity inside, which is connected to two concentric passageways which travel the length of the shaft supporting the cooling wheel. One passageway comprises a tube which provides intake water to the cavity. The other passageway is disposed between the intake tube and the shaft itself, and it allows the water to be drained away from the cavity. This circulation is important because if the water is not constantly circulated, it will become hot and no longer perform its cooling function.

The cooling wheel, however, acts as one of the pulleys to drive the wire continuously through the process, and it can also act as an electrical contact for the electrical annealing process (providing a fixed length for the portion of the wire being annealed.) However, the hub rotates as a result. The centrifugal force tends to keep the water against the walls inside the hub cavity. In order to prevent this stagnation, a scrubber is provided inside the cavity. The scrubber is a solid piece which is fixed in place to the stationary tube supplying the intake water to the hub cavity. The scrubber extends to but does not quite touch the inside walls of the hub cavity. When the hub rotates, the water is removed from the sides of the cavity by the scrubber, and as a result, the water circulates constantly.

The water cools the wire wrapped around the outer channel more rapidly than would occur with direct water contact. In addition, because the heat transfer is metal-to-metal (the wall of the channel is metal cooled by the circulating water inside the hub cavity), it can accurately be computed and thus monitored to maintain a uniform annealing quality for the wire.

DESCRIPTION OF THE PREFERRED EMBODIMENT DRAWINGS

We turn now to a brief description of the preferred embodiment after first briefly describing the drawings.

STRUCTURE

Figure 1:
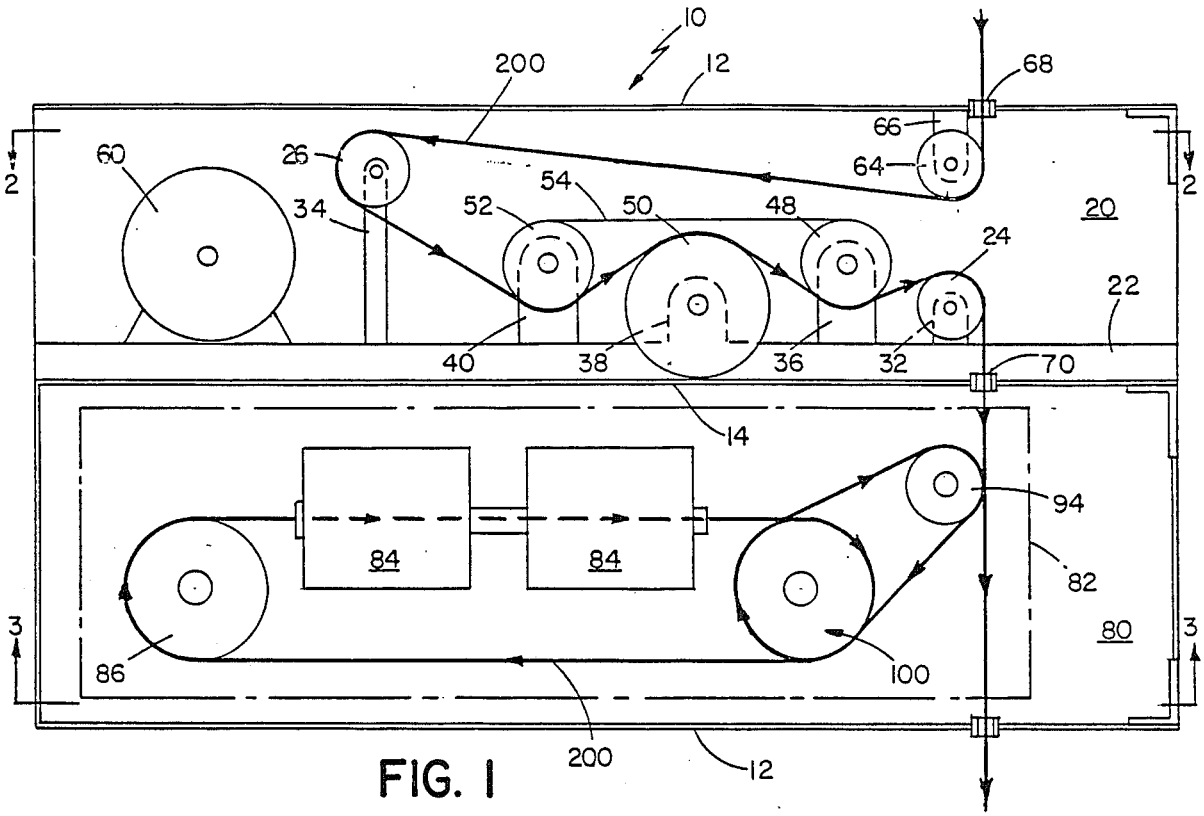
FIG. 1 is a simplified view of an induction-type wire annealing machine showing the pulleys and the direction of wire travel.

Referring to FIG. 1, an annealing machine is shown at 10. The machine 10 generally comprises two sections, a preliminary section 20 and an induction heating section 80. The sections 20, 80 are enclosed in a cabinet 12 with a wall 14 between them.

Figure 2:
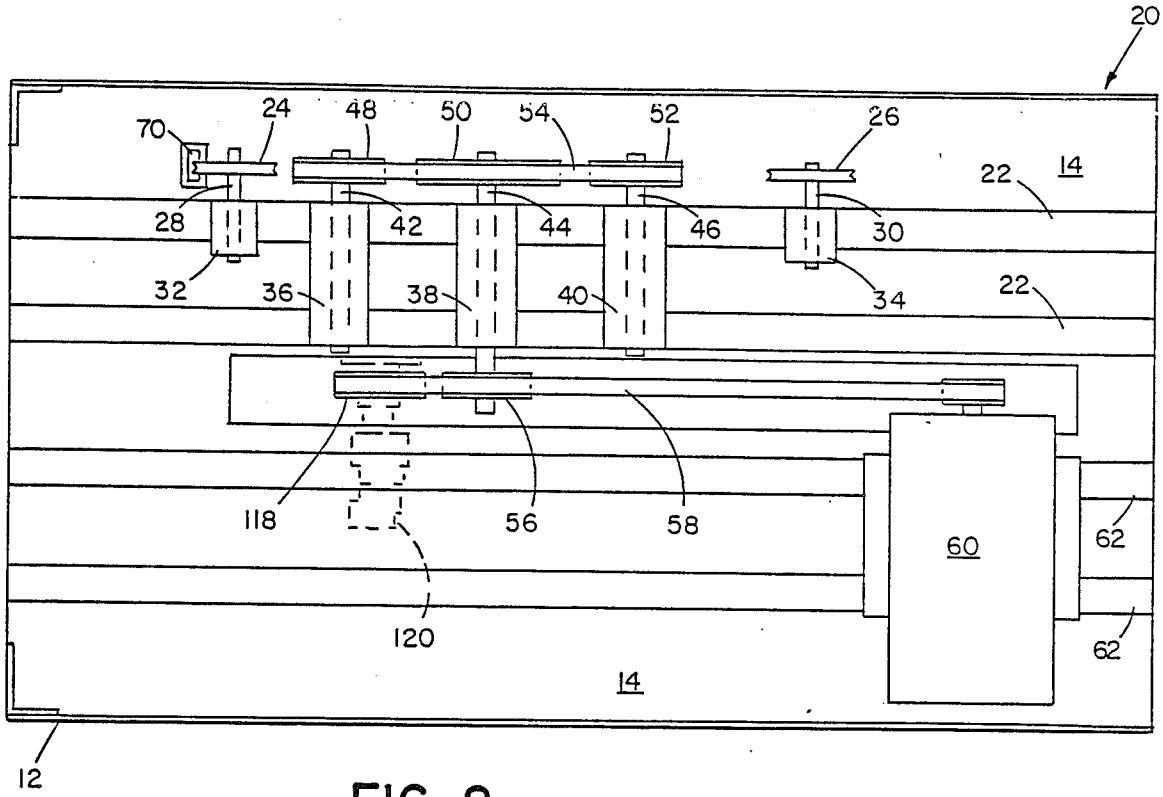
FIG. 2 is a view of the machine taken along lines 2—2 of FIG. 1.

The preliminary section 20 is shown in FIGS. 1 and 2. The section 20 comprises a first mounting 22 attached to the wall 14. The first mounting 22 holds a pair of single-grooved, idler wheels 24, 26. The wheels 24, 26 are mounted on shafts 28, 30 which are attached to the mounting 22 by connectors 32, 34. The first mounting also has a series of three connectors 36, 38, 40 for rotatably mounting shafts 42, 44, 46 of three pulleys 48, 50, 52. The pulleys 48, 50, 52 are connected by a belt 54. The shaft 44 of the central and major pulley 50 extend below the connector 38. A secondary wheel 56 is disposed on the end of the shaft 44 opposite the major pulley 50. The wheel 56 is connected by a drive belt 58 to a motor 60 connected to the wall 14 by a secondary mounting 62.

As shown in FIG. 1, the preliminary section 20 is completed by a single-grooved idler wheel 64 attached by connector 66 to the cabinet 12 adjacent to a wire inlet hole 68. A wire exit hole 70 is disposed in the wall 14 adjacent to idler wheel 24.

Figure 3:
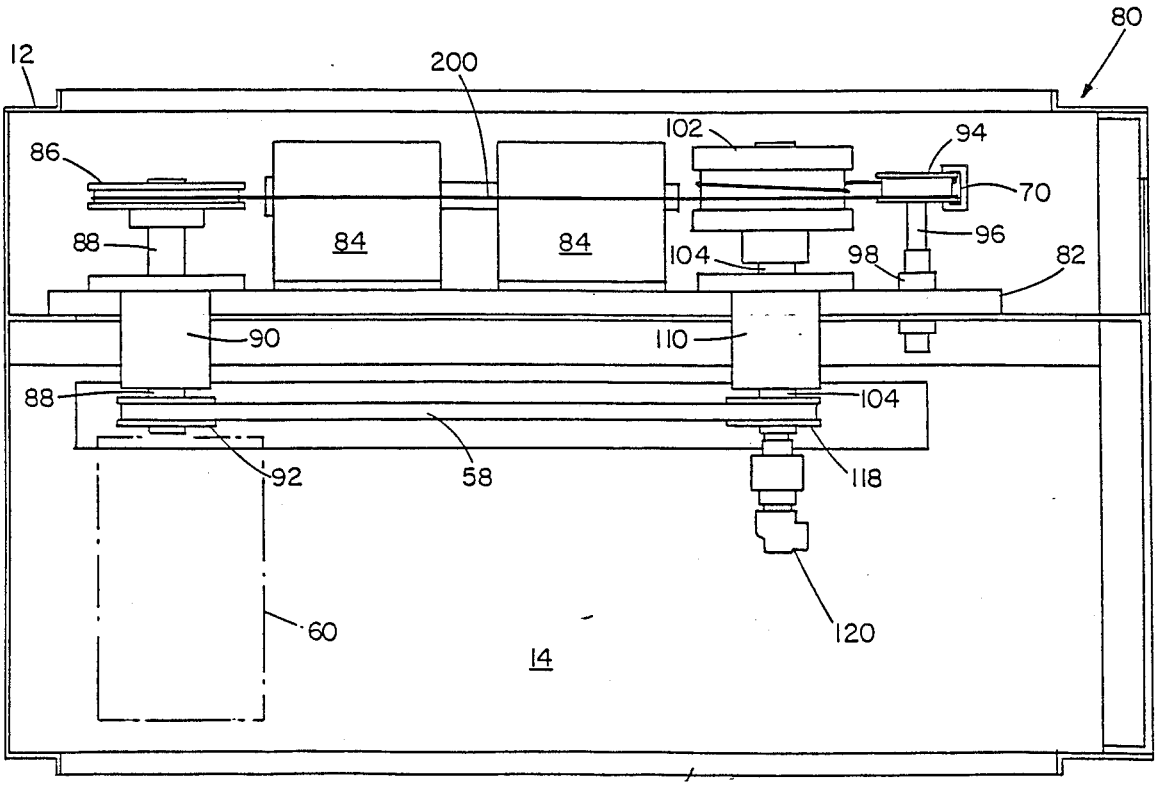
FIG. 3 is a view of the machine taken along lines 3—3 of FIG. 1.

The induction heating section 80 is shown in FIGS. 1 and 3. The induction heating section 80 comprises a plate 82 which is mounted to the cabinet 12. The plate 82 supports and induction heating unit 84. A single-grooved contact pulley 86 is disposed at the entrance to the induction heating unit 84. The pulley 86 is mounted on a shaft 88 which is mounted on a bearing 90. The shaft 88 extends below the bearing 90, and a secondary wheel 92 is mounted on it opposite the contact pulley 86. The wheel 92 receives the belt 58 from the motor 60, which belt 58 also drives the pulleys 48, 50, 52 of the preliminary section 20.

At the opposite end of the induction unit 84, an idler wheel 94 with multiple grooves is disposed on a shaft 96 which is attached to the plate 82 by connector 98. The wheel is disposed near and aligned with the wire exit hole 70 from the preliminary section 20.

A cooling wheel 100 is disposed adjacent to the exit from the induction heating unit 84. The cooling wheel 100 is best shown in an enlarged view in FIG. 4. The cooling wheel 100 generally comprises a hub 102, which is mounted on a hollow rotatable shaft 104. The shaft 104 is supported by a pair of bearings 106, 108 in a housing 110. The bearing housing 110 is fixed to the plate 82. The bearings 106, 108 are supported and held in place by retaining rings 112, 114 and separated by a spacer 116.

A belt drive wheel 118 is fixed to the hollow shaft 104 below the bearing housing 110. The wheel 118 receives the drive belt 58, which also drives the contact pulley 86 as well as the series of three pulleys 48, 50, 52 in the preliminary section 20. The shaft 104 terminates at a stationary rotary joint 120.

Figure 4:
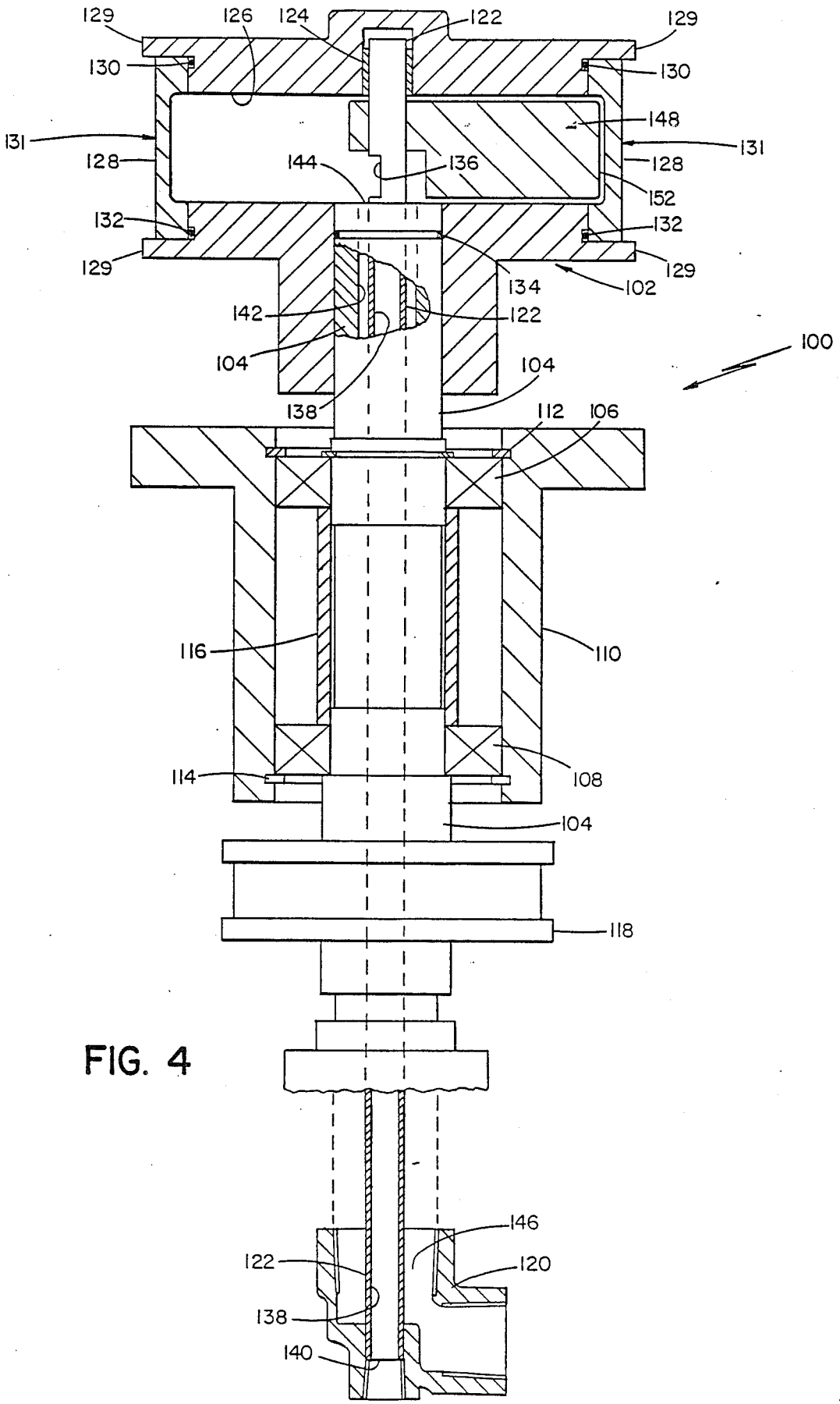
FIG. 4 is an enlarged cross-sectional view of the cooling wheel of this invention.

Internally, as shown in FIG. 4, a stationary tube 122 extends inside the shaft 104 from the rotary joint 120 to the hub 102. A bearing 124 supports the hub 102 on the tube 122 so that the hub 102 can turn freely around the tube 122. The hub 102 itself has a cylindrical hollow cavity 126 inside. The sides of the cavity 126 (and of the hub 102) are formed by a separate metal shoe 128. (The hub 102 can be made in a single piece without a separate shoe.) The hub 102 has a pair of tips 129, which extend beyond the top and bottom of the shoe 128 so as to form a wire-holding channel 131 around the outer circumference of the hub. The shoe 128 is sealed to the remainder of the hub 102 by O-rings 130, 132. An O-ring 134 also seals the outer shaft 104 to the hub 102.

Inside the cavity 126 of the hub 102, the stationary tube 122 has an outlet opening 136 which communicates with the cavity 126. Thus, there are two passageways in the cooling wheel shaft 104. An inlet passageway 138 extends from an inlet 140 at the rotary joint 120 through the tube 122 to the outlet opening 136 in the hub 102, while an outlet passageway 142, which exists inside the shaft 104 between its wall and the tube 122, extends from an inlet 144 between the rotatable shaft 104 and the stationary tube 122 at the hub 102 to an outlet 146 at the rotary joint 120.

Figure 5:
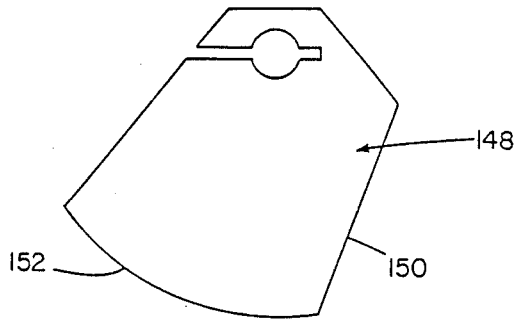
FIG. 5 is an enlarged top view of the scrubber of the cooling wheel of this invention.

Finally, a scrubber 148 is attached to the portion of the stationary tube inside the hub 102. The scrubber 148 is best shown in FIG. 5. It generally comprises a solid piece of brass or stainless steel which is generally pie-shaped, with a portion cut away to form an angled face 150. The scrubber 148 has a curved outer surface 152 which is disposed adjacent to but which does not touch the shoe 128 of the hub 102.

Other arrangements are, of course, possible, and the cooling wheel described herein may be used with other types of annealing apparatus.

OPERATION

In operation, as shown in FIG. 1, a drawn wire 200 is run into the hole 68 of the cabinet 12 and through the idler wheels 64, 26 and pulleys 48, 50, 52 of preliminary section 20. The pulleys 48, 50, 52 drive the wire 200 along at a constant, preselected speed. The wire 200 is then fed by the idler wheel 24, through the hole 70 in the wall 14 and into the induction heating section 80.

In the induction heating section 80, the wire 200 is supported by one of the grooves of idler wheel 94 and passed around a portion of the channel 131 of the cooling wheel 100. It then goes to the pulley 86. From there, it is fed through the induction heating unit 84 where it is annealed. This "leg" of the wire has a fixed length between the pulley 86 and the shoe 128 of the cooling wheel 100, which shoe 128 can act as an electrical contact. The heated wire is then wrapped around the shoe 128 in the channel 131 at least once. The heated wire is cooled there because of the metal-to-metal heat transfer between the wire 200 and the shoe 128. The shoe 128 is kept cool by the water recirculating in the cavity 126 of the hub 102.

Referring to FIG. 4, water is pumped into the inlet 140 of the stationary tube 122 inside the rotating shaft 104 for the cooling wheel 100. The water is pumped up the passageway 138 inside the tube 122, and it comes out of the tube 122 at its exit opening 136 inside the cavity 126 of the hub 102. Although the tube 122 is stationary, the hub 120 is not. It is rotating rapidly, and the water tends to flow against the inside walls of the hub 102 and stay there. However, the scrubber 148 is also stationary with the tube 122. This means that there is a relative rotational motion between the hub 102 and the scrubber 148. The face 150 of the scrubber 148 forces the water away from the wall of the hub, and the close clearance between the scrubber wall 152 and the hub 102 prevents the water from reattaching to the hub wall. As a result, the water drains out the exit opening 144 between the shaft 104 and tube 122 inside the hub 102. The water drains down the passageway 142 between the shaft 104 and the tube 122 and out the drain opening 146. Circulation of the water is maintained in this manner, and the wire around the channel of the cooling wheel 100 is properly cooled.

As the heat transfer is a metal-to-metal one, it can be accurately calculated. In addition, because the heat transfer is predictable, it is possible to maintain consistent wire quality much more easily than with water quench cooling techniques.

Other variations will occur to those skilled in the art.

What we claim is:

1. An apparatus for annealing wire comprising:

a means for heating a selected portion of wire to a suitable temperature for annealing, a cooling means disposed after said means for heating to reduce the temperature of the annealed portion of the wire, said cooling means comprising a rotatable hub mounted on a shaft, said hub having a channel forming its circumference, said channel receiving the wire to be cooled, which wire contacts a surface of said channel, said hub having a hollow cavity disposed opposite said channel and sealed therefrom, a scrubber disposed inside of said cavity of said hub, at least a portion of said scrubber being disposed so as to be immediately adjacent to the inside of said hub opposite said channel, said hub rotating when in use while said scrubber remains stationary, and a means for recirculating cooling water from said shaft through said cavity, the water being prevented from remaining stationary in said cavity by said scrubber which does not turn with said rotating hub, said means for recirculating also comprising a stationary outlet passageway towards which said scrubber directs the water.

2. The apparatus of claim 1 wherein said hub is cylindrical and said channel is bounded by a pair of continuous extensions which help keep wire in said channel.

3. The apparatus of claim 2 wherein said surface of said channel is metal which acts as an electrical contact for the annealing process.

4. The apparatus of claim 1 wherein said means for recirculating cooling water through said cavity of said hub comprises an inlet passageway and an outlet passageway disposed inside said shaft, which said passageways are in communication with said cavity.

5. The apparatus of claim 4 wherein said inlet passageway comprises a tube which communicates with said cavity of said hub.

6. The apparatus of claim 5 wherein said tube is stationary and extends into said hub.

7. The apparatus of claim 6 wherein said shaft which rotates with said hub is hollow and is disposed around but at least partially spaced apart from said stationary tube, said outlet passageway being formed by the space between said tube and said shaft.

8. The apparatus of claim 1 wherein said scrubber has an angled face.

9. The apparatus of claim 4 wherein said inlet passageway comprises a stationary tube which extends into said cavity of said hub, said stationary tube having said scrubber attached thereto.

10. The apparatus of claim 12 wherein said scrubber is solid and extends almost to the outer edge of said cavity, said scrubber being substantially wedge-shaped and having an angled face which is disposed towards the direction of the rotation of said hub.

* * * * *